United States Patent [19]

Marmo

[11] 4,354,811

[45] Oct. 19, 1982

[54] WORKPIECE PELLET LENGTH CONTROL APPARATUS

[75] Inventor: Anthony R. Marmo, Cheswick, Pa.

[73] Assignee: Westinghouse Electric Corp., Pittsburgh, Pa.

[21] Appl. No.: 171,221

[22] Filed: Jul. 22, 1980

[51] Int. Cl.[3] ..... B28B 17/00

[52] U.S. Cl. ..... 425/140; 425/150; 264/40.5

[58] Field of Search ..... 425/140, 150; 264/40.5

[56] References Cited

U.S. PATENT DOCUMENTS

| | | | |
|---|---|---|---|
| 2,499,665 | 3/1950 | Mestas | 336/134 |
| 3,129,482 | 4/1964 | Wellnitz | 425/140 |
| 3,255,716 | 6/1966 | Knoechel et al. | 264/40.5 |
| 3,480,999 | 12/1969 | Carlo | 425/140 |

*Primary Examiner*—James R. Hall

*Attorney, Agent, or Firm*—R. G. Brodahl

[57] ABSTRACT

There is disclosed a workpiece pellet length control apparatus for providing a desired formed pellet length from a multicavity press apparatus. Apparatus is provided to measure the length of each formed workpiece pellet for the purpose of controlling the formed pellet lengths and to reject pellets that are outside of acceptable length tolerance limits.

7 Claims, 9 Drawing Figures

WORKPIECE PELLET LENGTH CONTROL APPARATUS

BACKGROUND OF THE INVENTION

This invention relates to the manufacture of nuclear fuel pellets by a multi-cavity pellet press apparatus, where it is desired to provide workpiece pellets of substantially constant lengths. It is known to provide press apparatus including a plurality of upper punches that are hydraulically operated and mounted in a support head and coupled with a hydraulic pressure compensator that provides a controlled and similar pressure to all pellets within a like plurality of cavities to determine a substantially uniform and constant density of the respective pellets. It is known that a multiple cavity press apparatus, when a substantially constant density individual pellet is desired and formed, can result in some variation in the respective pellet lengths because of powder material characteristic differences and the gravity filling of the plurality of pellet cavities. Each pellet forming cavity includes a respective lower punch that can be adjusted in position to control the desired length of the pellet formed in that cavity.

SUMMARY OF THE INVENTION

A pellet length control apparatus is provided including apparatus to detect the length of each pellet leaving the pellet press and apparatus to control the press operation to provide a correction adjustment of the cavity depth when the pellet lengths go outside predetermined limits. A defective pellets diverting mechanism is included to remove any out of length tolerance pellets.

DETAILED DESCRIPTION OF THE INVENTION

Figure 1:
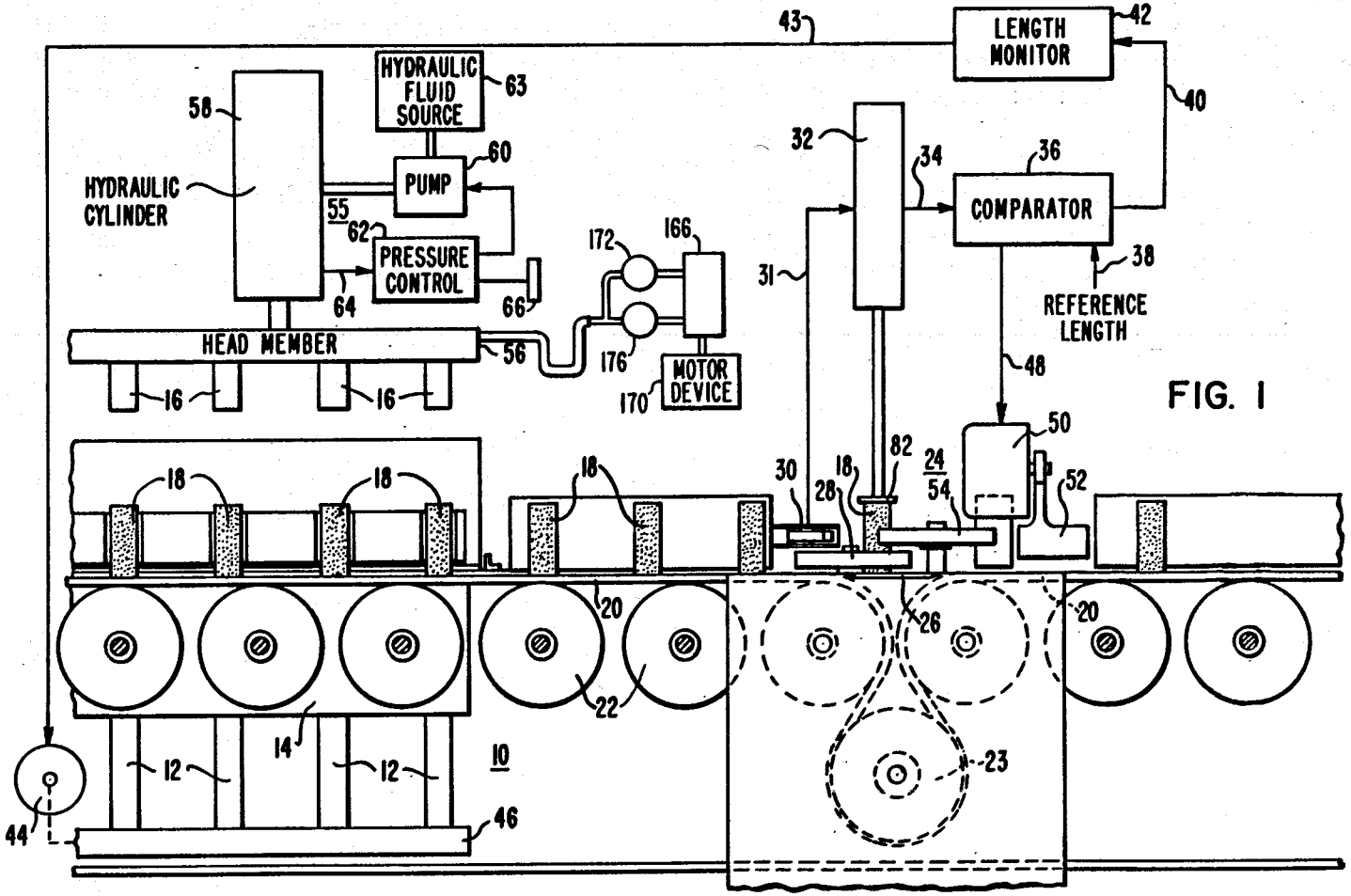
FIG. 1 shows the workpiece pellet length control apparatus of the present invention.

In FIG. 1 there is shown the pellet press 10 including lower punches 12 operative with respective pellet forming cavities provided within a body member 14 and cooperative in relation to corresponding upper punches 16 to press powder material such as uranium dioxide within each said cavity to produce workpiece pellets 18. The pellets 18 are supplied to a conveyor apparatus including a moving belt 20 operaive with support rollers 22 for carrying the workpiece pellets 18 from the press 10 to a length measuring apparatus 24. The moving belt 20 carries the workpiece pellets onto a fixed position anvil 26 by pushing each pellet individually between a pair of input feed wheels 28, which then move that pellet onto the anvil 26. A position sensing microswitch 30 detects the passage of each pellet in relationn to the pair of input feed wheels 28 and provides a signal 31 to the pellet length determining apparatus 32, such as a linear variable differential transformer, for initiating the length measurement by the apparatus 32 of the pellet 18 positioned on the anvil 26. The pellet actual length signal 34 is supplied to a comparator 36 for comparison with a desired reference pellet length signal 38. The resulting length error signal 40 is provided to a length monitor device 42 which operates after a predetermined time delay with a servo motor 44 for controlling the relative location of a base member 46 which in turn positions the lower punches 12 in relation to the body member 14 and the pellet forming cavities within that body member 14.

The comparator 36 operates to sense a defective workpiece pellet, which is outside of established desired maximum and minimum tolerance limits and provides a reject signal 48 to an eject mechanism 50 having an eject arm 52 which removes any defective out-of-length tolerance pellet from the conveyor belt 20. After the length measurement of the present workpiece pellet 18 positioned on the anvil 26 is completed the next succeeding pellet moved by the pair of input feed wheels 28 onto the anvil 26 will then push the present pellet into the pair of exit feed wheels 54 for moving the present pellet onto the moving conveyor belt and past the eject mechanism 50 and the eject arm 52.

The upper punches 16 are moved vertically by a suitable mechanism 55, such as a head member 56 coupled with a hydraulic cylinder 58 and a pump 60 operative with pressure control apparatus 62, that provides a desired pressure to all upper punches 16 as the mechanism 55 lowers the upper punches 16 in relation to the pellet forming cavities within the body member 14. A hydraulic fluid source 63 operates with the pump 60, and the pressure control regulator 62 responds to the actual pressure 64 to determine a desired fluid pressure within the hydraulic cylinder 58 in accordance with a manually adjustable pressure reference 66.

The conveyor belt 20 is moved along the support rollers 22 and carries individual workpiece pellets 18 from the press 10 to the pair of input feed wheels 28. As the respective pellets move onto the anvil 26 one at a time for a length measurement, the belt 20 loops down and around the support wheel 23 and up onto the support rollers 22 to the right for moving the pellets 18 past the eject mechanism 50.

Figure 2:
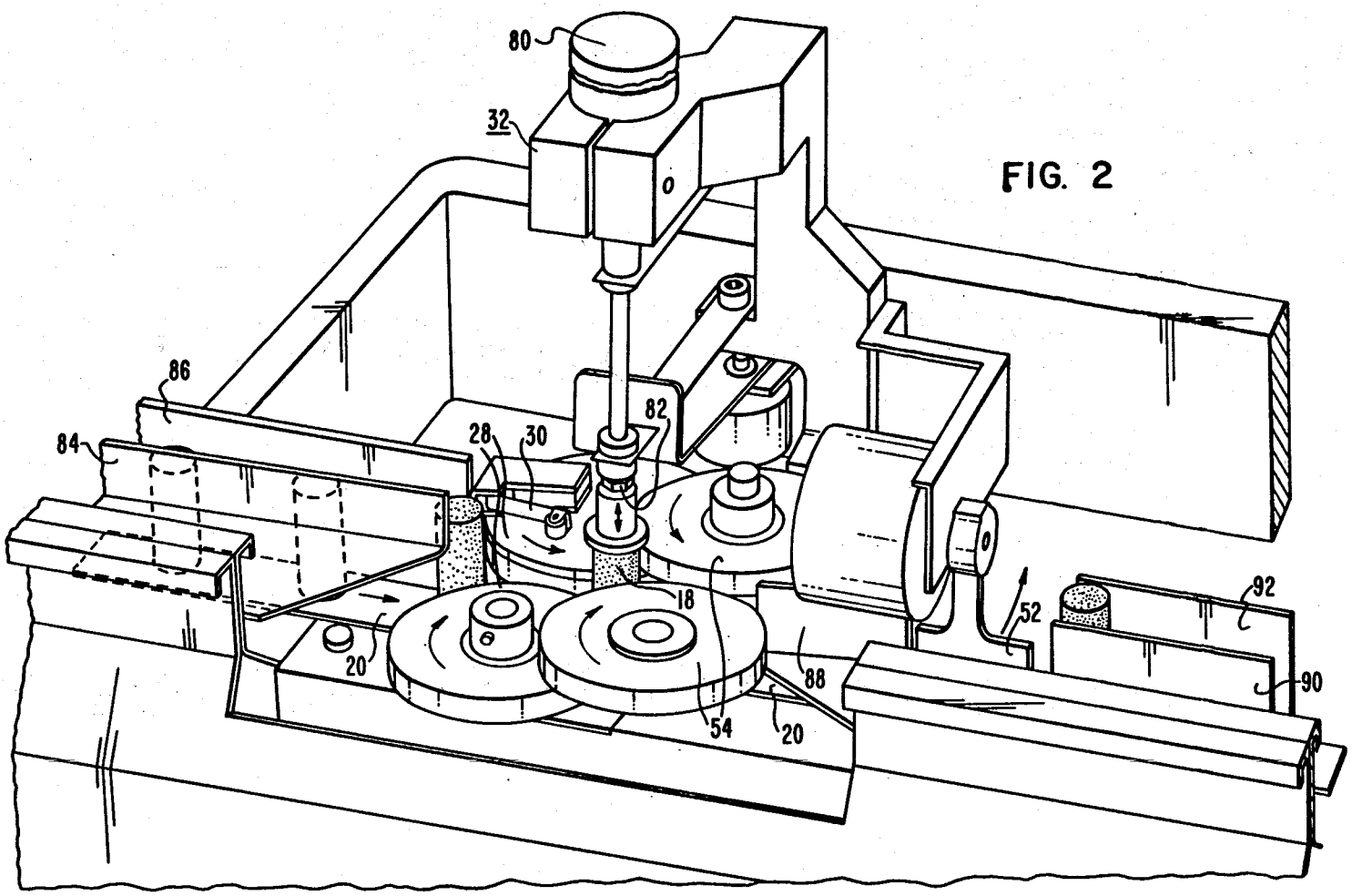
FIG. 2 shows the workpiece pellet length determining apparatus operative with successive pellets.

In FIG. 2 there is shown the pellet length determining apparatus 32, which can include a linear variable differential transformer length measurement device 80 such as described in U.S. Pat. 2,499,665 of R. Mestas, and which has a variable air gap determined by the head member 82 being lowered to rest upon the top of the workpiece pellet 18. The air gap depends upon the actual length of the workpiece pellet 18. The pellet 18 is resting on the fixed position anvil 26, as shown in FIG. 1, and is initially carried by the conveyor belt 20 between the vertical support members 84 and 86 toward the pair of input feed wheels 28, which rotate as shown by the arrows at a speed coordinated with the conveyor belt 20, and feeds an individual pellet 18 from the conveyor belt 20 into the position shown in FIG. 2 in alignment with and under the length measuring device 32. The microswitch 30 senses the passage of the pellet and operates to signal the length measurement device 32 to measure the length of the pellet 18 resting upon the anvil 26. A succeeding pellet is then taken from the conveyor 20 by the pair of input feed wheels 28 and moves into the length measurement position shown in FIG. 2 while pushing the previous pellet into operation with a pair of exit feed wheels 54. The latter feed wheels 54 then move the previous pellet to the right onto the conveyor 20 and past the vertical support member 88 past the ejection arm 52 and between the vertical support members 90 and 92.

Figure 3:
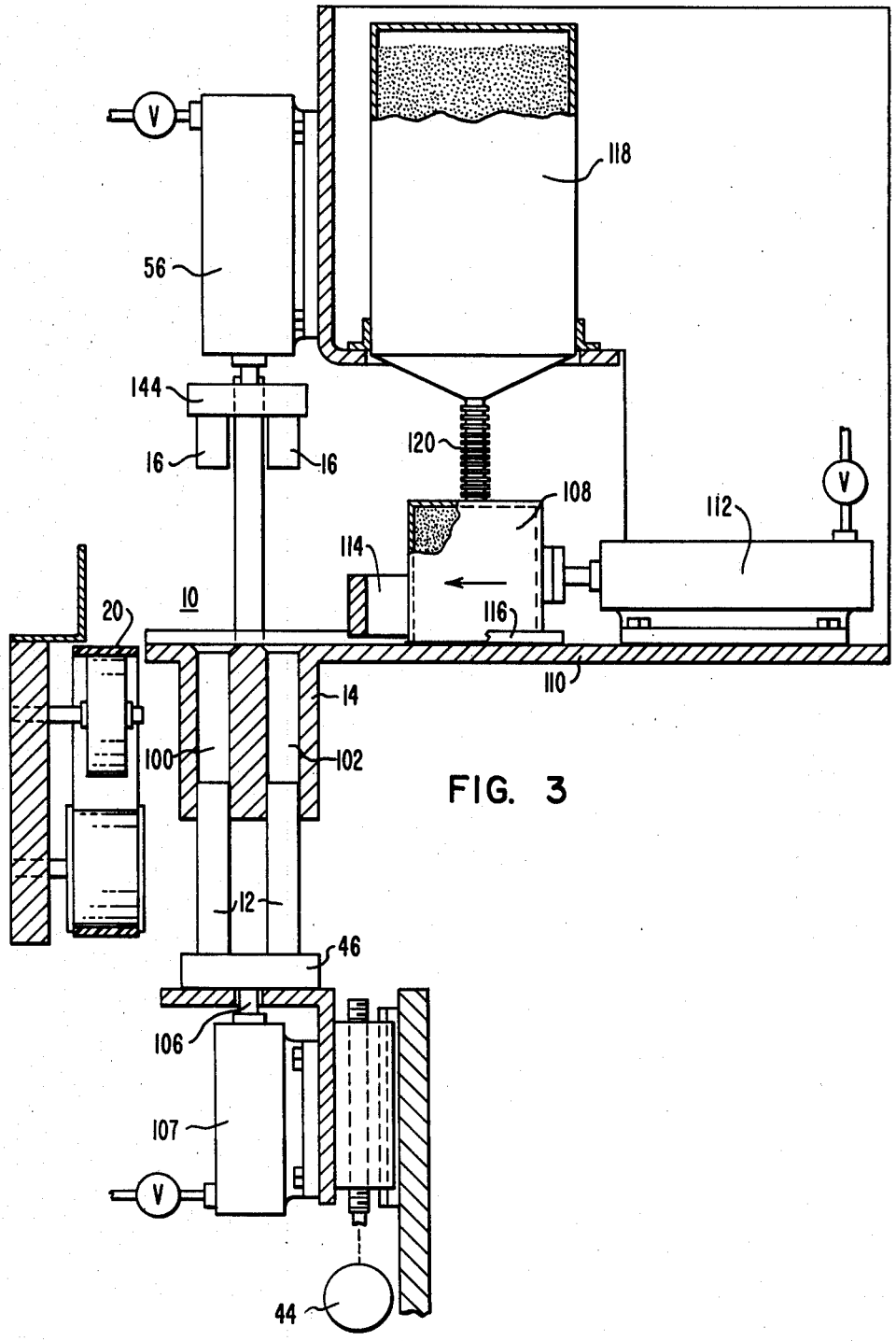
FIG. 3 shows the pellet press apparatus before workpiece powder is supplied to the multiple pellet forming cavities.

In FIG. 3 there is provided an end view of the pellet press 10 shown in FIG. 1 and illustrating two pellet forming cavities 100 and 102 within the body member 14. The upper punches 16 are shown operative with the vertical movement mechanism 55 and elevated above the respective cavities 100 and 102, with the lower punches 12 having an adjustable vertical position within the respective cavities 100 and 102 as determined by the height of the base member 46. The servo motor 44 controls the height of the base member 46. For example, a fastener rod 106 can operate with a hydraulic cylinder 107 as determined by the operation of the servo motor 44 to adjust the height of the lower punches 12 and thereby the resulting length of the pressed workpiece pellets leaving the press apparatus 10.

A shoe box container 108, filled with the input powder material which fills the cavities 100 and 102 and is pressed in the cavities to form the respective workpiece pellets, is moved horizontally along the table 110 by a hydraulic cylinder 112. As the shoe box 108 moves to the left, the front bumper 114 pushes any pressed pellets emerging from the press apparatus 10 onto the conveyor belt 20 for moving the pellets in a direction perpendicular to the drawing as shown in FIG. 3. As the shoe box passes over the empty cavities 100 and 102, those cavities will fill by gravity with loose powder from within the shoe box 108, and as the shoe box 108 subsequently moves to the right and back to the position shown in FIG. 3 the lip 116 will wipe across the top of the filled cavities and remove any powder not actually within the cavities 100 and 102. A powder source 118 is coupled through a flexible feed tube 120 for keeping the shoe box 108 full of loose powder suitable to be pressed by the pellet press 10.

Figure 4:
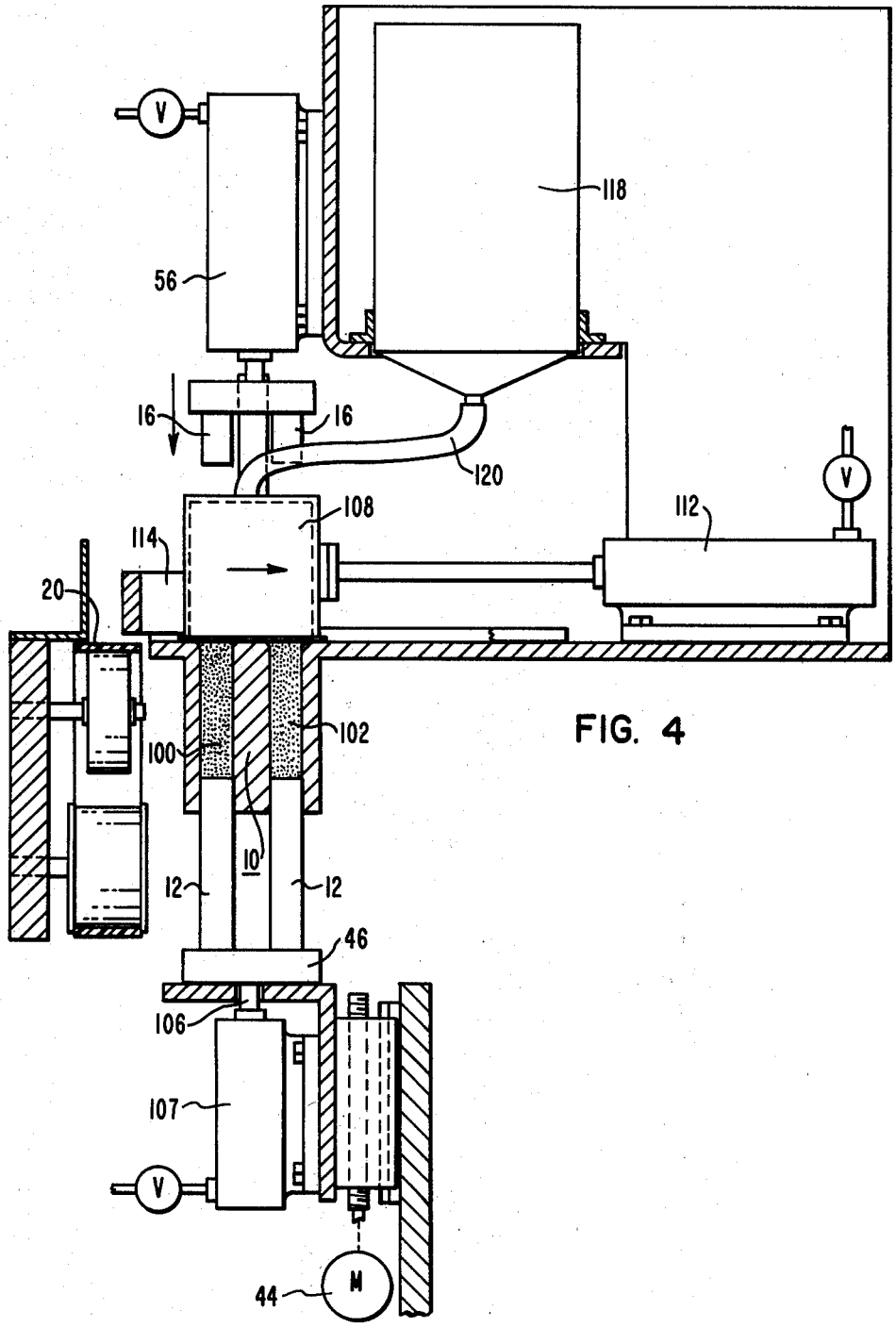
FIG. 4 shows the pellet press apparatus after the multiple pellet forming cavities have been filled with workpiece powder.

In FIG. 4 the shoe box 108 is shown positioned to gravity fill the cavities 100 and 102 with loose powder in preparation for the upper punches 16 to be lowered and to compress the powder within the respective cavities 100 and 102 to form desired workpiece pellets.

Figure 5:
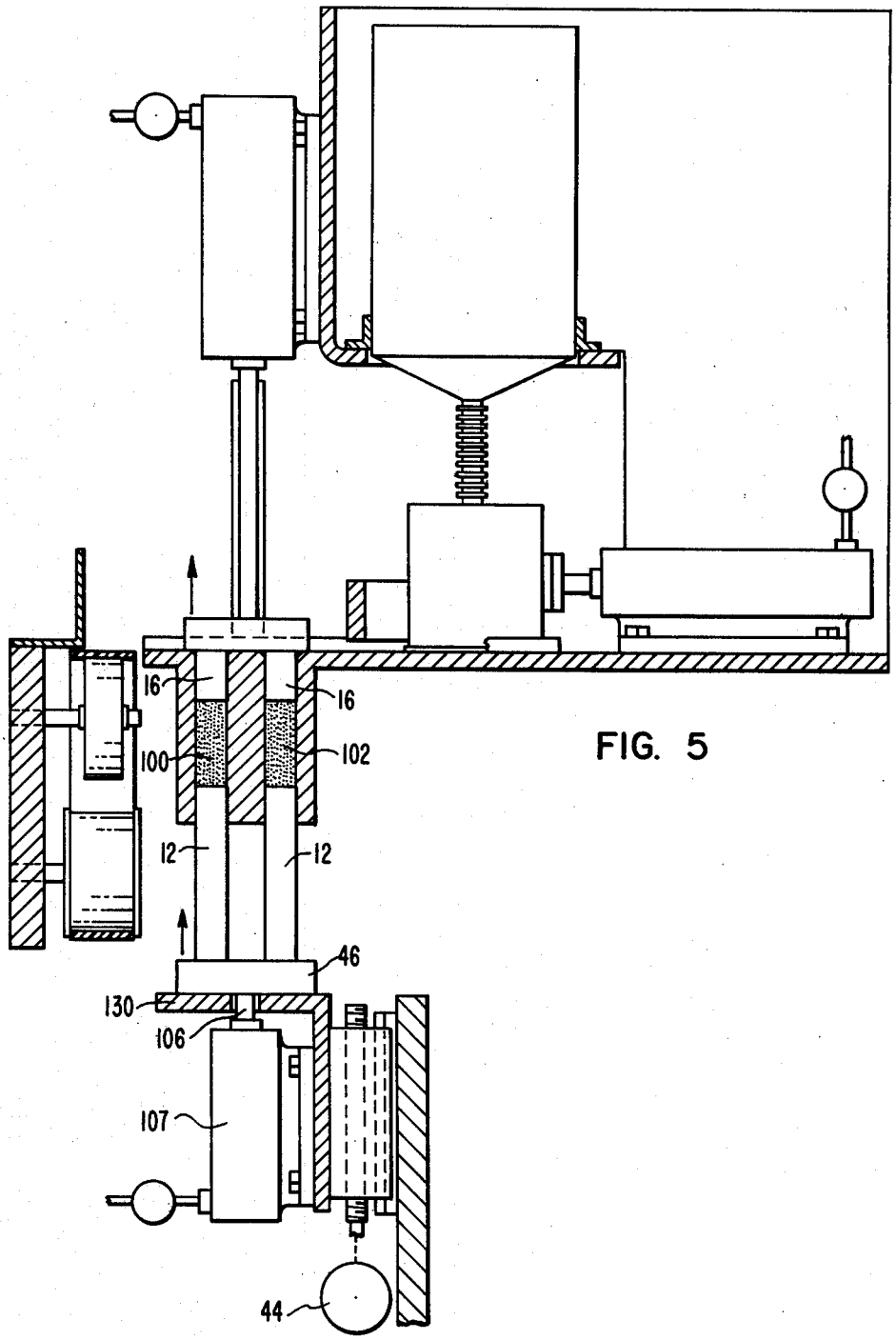
FIG. 5 shows the upper punches lowered to compress the workpiece powder to form the pellets in the multiple pellet forming cavities.

In FIG. 5 the upper punches 16 have been lowered into the respective cavities 100 and 102 to compress the powdered material within those cavities and to form the workpiece pellets. The lower punches 12 determine the bottom end surface of those pellets and can be raised or lowered by adjusting the position of the base member 46 in relation to the base support 130 by operation of the servo motor 44 and associated hydraulic piston and cylinder 107 coupled with the fastener rod 106. The base support member 130 and the table 110 are fixed in relative positions.

Figure 6:
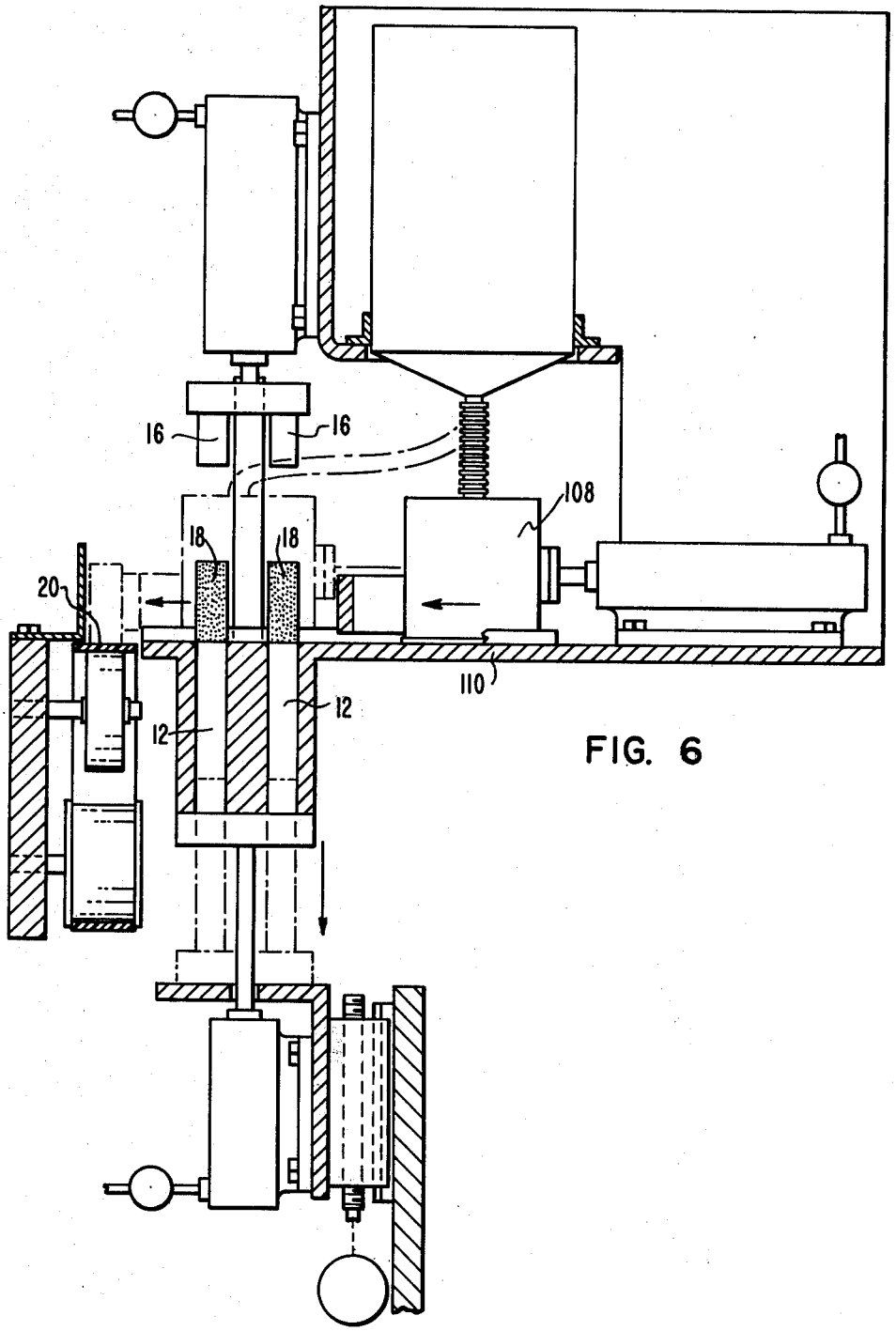
FIG. 6 shows the upper punches raised above the cavities and the lower punches raised to remove the formed pellets from the cavities.

In FIG. 6 the upper punches 16 have been elevated above the height of the shoe box 108 and the lower punches 12 have been raised so the top of each lower punch 12 is at the same level as the upper surface of the table 110. As the shoe box 108 is moved to the left, as shown in the phantom drawing, the bumper 114 pushes the formed pellets 18 onto the conveyor 20. The lower punches 12 are then lowered into the bottom rest position, as shown in phantom, and the powder again fills the cavities as shown in FIG. 4.

Figure 7:
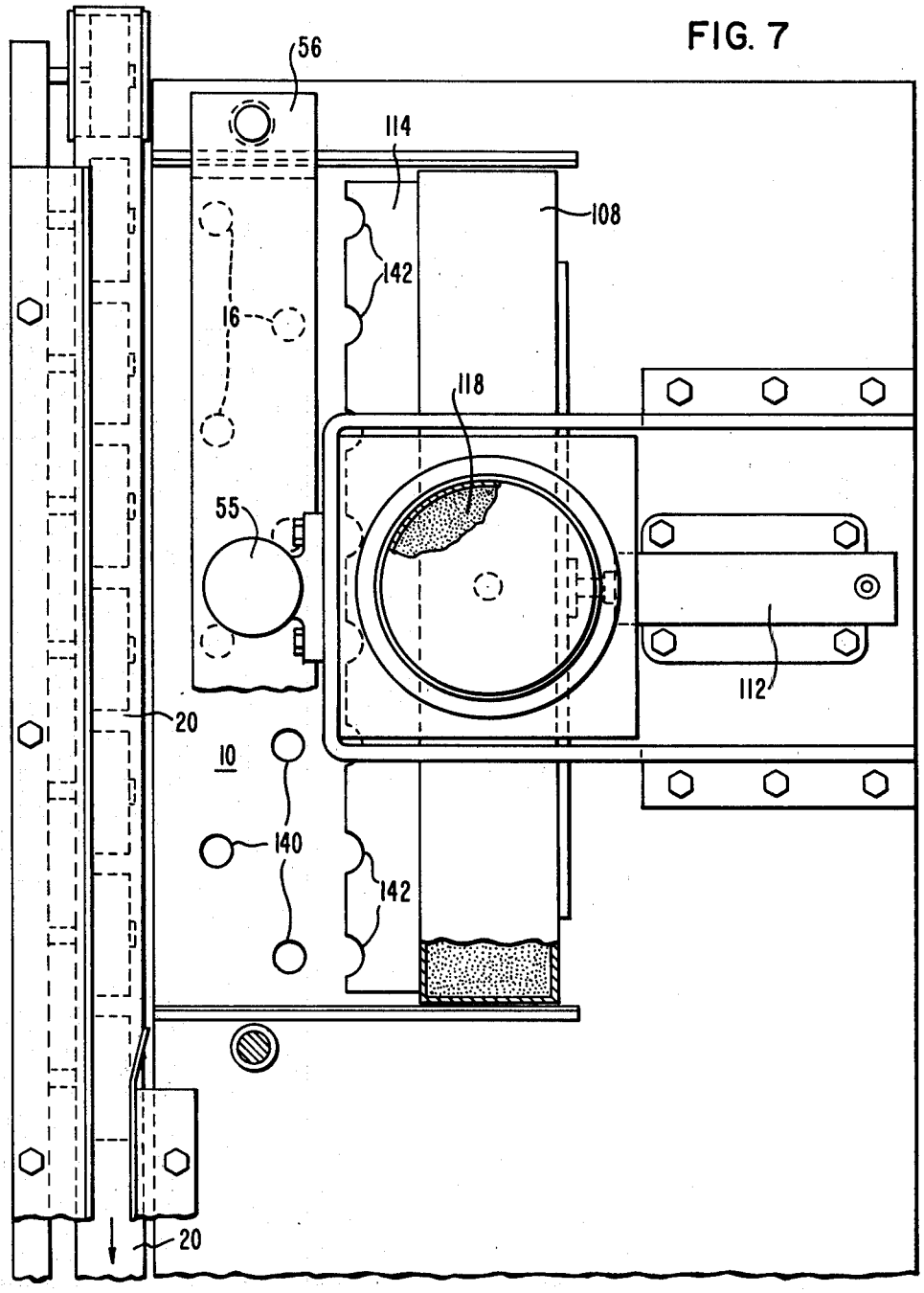
FIG. 7 shows a top view of the pellet press apparatus operative with the movable shoe member to remove the pellets from the press apparatus.

In FIG. 7 there is shown a top view of the pellet press apparatus 10, including a plurality of the pellet forming cavities 140. The cavities 100 and 102 shown in FIGS. 3 to 6 could be two of this plurality of cavities. The powder source 118 is coupled with the shoe box 108 and the front bumper 114 includes notch shaped openings 42 for pushing the formed pellets onto the conveyor belt 20. The upper punches 16 are moved by the head member 56 as determined by the vertical movement mechanism 55.

The microswitch 30 shown in FIG. 1 and mounted just before the input feed wheels 28, includes an operative time delay to control the pellet length measuring apparaus 32 to come down for a length measurement when a pellet 18 is in place on the anvil 26 and in alignment with the head 82 of the length measuring apparatus 32. The respective pellet length measurements are sequenced through the length monitor 42 operating as a memory device to sense any length error trend due to changed powder characteristics or the like, such as the formed workpiece pellets 18 are becoming too short or too long. If one of the punches 12 or 16 happens to break and the associated pellet forming cavity becomes inoperative for this reason, the length monitor 42 is operative to determine through the sequence of length measurements that such a condition has happened and a suitable alarm is sounded to identify the inoperative cavity. In a typical operation the workpiece pellets are positioned on the conveyor belt 20 at approximately 1 and ½ inch intervals apart. The input feed wheels 28 are spaced from the output feed wheels 54 such that a suitable idle position is provided for the workpiece pellet 18 positioned on the anvil 26 while the length measurement is being made. The rotational speed of the feed wheels 28 and 54 can be controlled by a motor and a suitable speed controlling rheostat operative with a power supply such that the speed of the feed wheels 28 and 54 is synchronized with the operational speed of the press apparatus 10 and the conveyor belt 20 to satisfactorily move the respective workpiece pellets into and out of the length measurement position resting on the anvil 26. When the actual length measurements of the workpiece pellets have an out-of-tolerance condition within a first band of limits, a signal 43 is provided by the length monitor 42 to the servo motor 44 for adjusting the position of the head member 46 and the lower punches 12 to correct this out-of-tolerance length condition. When the actual length measurements of one or more of the workpiece pellets are out of a second and greater band of tolerance limits the reject arm 52 is operated through operation of the solenoid 50 to remove that one or more workpiece pellets from the conveyor belt 20. If the humidity of the powder contained in the powder source 118 becomes too moist or too dry, this can change the powder characteristics such that the filling of the pellets forming cavities will change and this can result in formed pellets that are too long or too short. The length monitor 42 can be a digital hold meter with a summing device, such as Model DM-2000AR presently available in the open market from Datal Company, that makes a comparison of the reference length 38 with the actual length 34 on a one pellet by one pellet basis and operates with the length monitor 42 to provide an integral memory of the trend of the pellet lengths through a sequence of successive pellet length readings that will indicate when an out-of-tolerance length condition trend is occurring. In addition, the comparison apparatus 36 is operative to compare the pellet from each cavity at the present run of the press apparatus 10 with the formed pellet from the same cavituy for the previous operation and for the next operation of the press apparatus 10, and in this way monitor the length trend of the workpiece pellets from the individual forming cavity operations.

Figure 8:
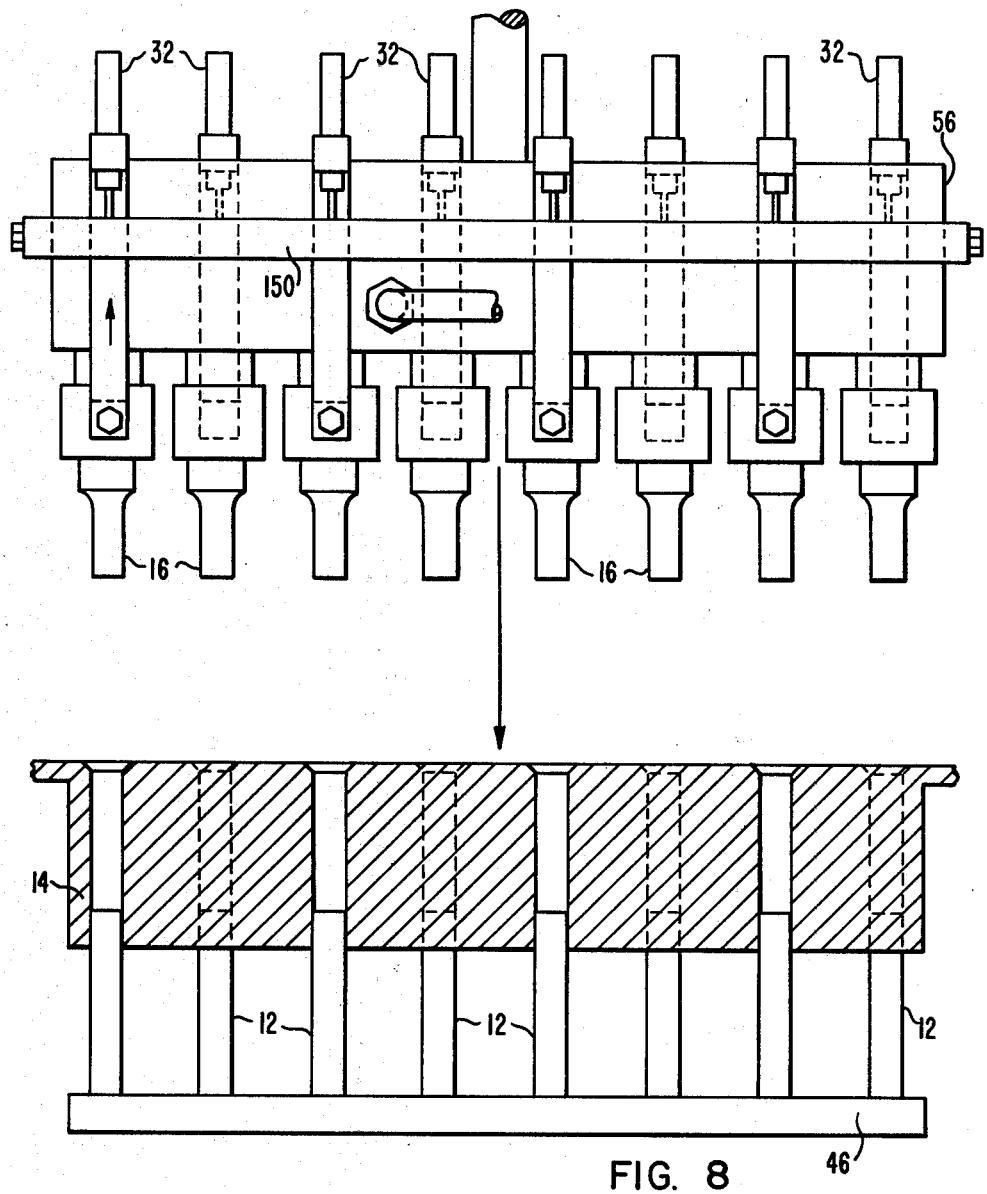
FIG. 8 shows a side view of a modified embodiment of the workpiece pellet length control apparatus of the present invention.

In FIG. 8 there is shown a modified embodiment of the workpiece pellet length control apparatus of the present invention. A pellet length determining apparatus 32 is individually provided in line with each of the upper punches 16 and can be coupled with a length comparator and monitor apparatus, such as shown in FIG. 1, to develop a length error signal for each individual pellet, which can then be utilized to establish a pellet length error trend for controlling the relative position of the base member 46 and the lower punches 12 and to operate the eject mechanism and the eject arm shown in FIG. 1 in relation to any one or more workpiece pellets that are outside of acceptable tolerance length limits. Each individual length determining apparatus 32 moves with its associated upper punch 16. A reference height for the upper punches 16 can be established by the contact bar 50, such that as the upper punches 16 enter the respective pellet forming cavities each length determining apparatus 32 physically rests against the contact bar 150 and as the associated upper punch 16 compresses the workpiece powder in a die cavity the cooperative length determining apparatus 32 will detect the motion of its upper punch 16 in relation to the contact bar 150 to provide an actual length measurement of the pellet formed in that cavity.

Figure 9:
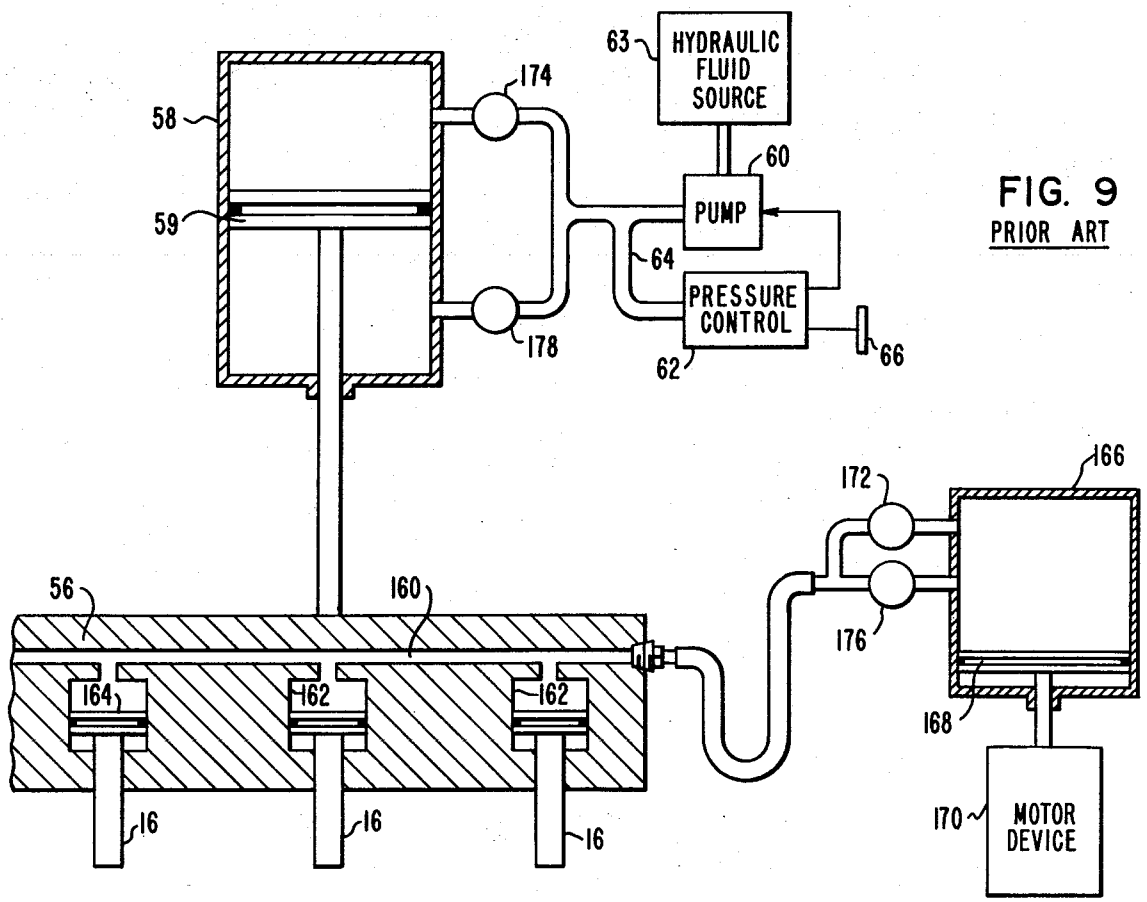
FIG. 9 PRIOR ART
FIG. 9 illustrates an example of the hydraulic pressure compensator arrangement for the upper punches shown in FIG. 1.

In FIG. 9 there is shown one example of a prior art hydraulic pressure compensator arrangement suitable for controlling the operation of the upper punches 16, which are shown in FIG. 1 and to establish the desired uniform density pellet. The hydraulic cylinder 58 can provide the total vertical force required for the whole operation of all the plurality of upper punches 16 with the respective pellet forming cavities to press workpiece pellets as shown in FIG. 5. If each upper punch 16 applies a downward pressure of about five tons per cavity to form a workpiece pellet in that cavity, and there is a total of eight such cavities as shown in FIG. 7, this requires a downward force by the hydraulic cylinder 58 of about forty tons. The head member 56 includes a fluid manifold 160 operaive with individual cylinders 162, that each include a floating piston 164. A closed fluid reservoir 166 includes a movable piston 168 driven by a suitable motor device 170. Each piston 164 is coupled with an upper punch 16. The cylinder 58 includes a movable piston 59 to move the head member 56 vertically. When the solenoid valve 174 is opened to output pressure from the pump 60, the piston 59 and head member 56 move downward to force the upper punches 16 into their respective cavities and to press the powder material into workpiece pellets. The solenoid valve 172 is closed during this downward movement and the pressure relief valve 176, set to maintain a maximum pressure in manifold 160 corresponding to about a five ton pressure limit for each upper punch, then determines the upward relative movement of any one or more of the cylinders 164 as required to provide the desired and corresponding density of each workpiece pellet. When the solenoid valve 174 is closed to stop the downward movement of the head member 56 and the solenoid valve 178 is opened to raise the head member 56, the upward movement of the head member 56 is operative with the motor device 170 to raise the piston 168 and with the solenoid valve 172 now open this applies fluid pressure in the manifold 160 to lower each of the pistons 164 and associated upper punches 16. The solenoid valve 172 is then closed in preparation for the next downward movement of the head member 56. A safety stop can be provided to give a desired lowermost position for the cylinder 58 to assure that the top punches 16 would not reach a position to touch the cooperating lower punches. As shown in FIG. 2, the support member 84 is positioned above the conveyor belt 20 by a sufficient distance such that any workpieces 18 that may have fallen over and are lying horizontally on the conveyor belt 20, can be removed from the conveyor belt 20 and not moved into the input feed wheels 28. This can be done with an air jet that blows across the conveyor belt 20 at a location before the workpiece pellet 18 moves into the input feed wheels 28.

I claim:

1. In workpiece length control apparatus for determining the length of workpiece pellets formed from powder material provided in a holding cavity, the combination of first means including a first member movable within said cavity for forming a workpiece pellet from said powder material, second means including a second member positioned within said cavity for determining the length of the formed workpiece pellets and movable for removing said formed workpiece pellet from said pellet forming first means, third means including a length measurement device cooperative with the workpiece pellet formed in said cavity by a previous operation of the firt and second means for determining the actual length of said workpiece pellet in relation to a desired length, and fourth means responsive to said determined length and connected to determine the position of at least one of the pellet forming first means and the pellet removing second means for controlling the actual length of the workpiece pellet formed in said cavity by another operation of the first and second means.

2. The workpiece length control apparatus of claim 1, with said pellet length controlling fourth means being connected to the pellet removing second means.

3. The workpiece length control apparatus of claim 1, with said first member of the pellet forming first means being movable into said cavity in opposition to the second member for pressing the powder material into a workpiece pellet.

4. The workpiece length control apparatus of claim 3, with said second member being movable into said cavity to remove the formed workpiece pellet from that cavity.

5. In workpiece pellet length control apparatus for establishing the length of a workpiece pellet formed from powder material provided in at least one holding cavity, the combination of first means including a member movable within said cavity to provide one pressing of the powder material in said cavity to form a workpiece pellet, second means movable within said cavity for removing the formed workpiece pellet from said cavity after said one pressing of the powder material, third means coupled with the workpiece pellet formed in said cavity for determining the length of the formed workpiece pellet, and fourth means responsive to said determined length and connected to determine the position of one of the first means and the second means for controlling the length of the formed workpiece by adjusting the holding cavity depth for another pressing of the powder material in said cavity.

6. The workpiece pellet length control apparatus of claim 5, with the length controlling fourth means being coupled with the pellet removing second means.

7. The workpiece pellet length control apparatus of claim 5, with said pressing first means including a movable member positioned within each of a plurality of cavities for pressing respectively powder material provided within each said cavity to form a workpiece pellet in each said cavity, and with said pellet removing second means including a second movable member positioned within each of said cavities in response to said determined length and operative to remove a formed workpiece pellet from each said cavity.

* * * * *